US011123747B2

(12) United States Patent
Dallimore et al.

(10) Patent No.: US 11,123,747 B2
(45) Date of Patent: Sep. 21, 2021

(54) VSI-CRUSHER FEED HOPPER DISTRIBUTION DEVICE

(71) Applicant: SANDVIK INTELLECTUAL PROPERTY AB, Sandviken (SE)

(72) Inventors: Rowan Dallimore, Bath (GB); Andreas Forsberg, Malmo (SE); Knut Kjaerran, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 762 days.

(21) Appl. No.: 14/900,650

(22) PCT Filed: May 19, 2014

(86) PCT No.: PCT/EP2014/060229

§ 371 (c)(1),
(2) Date: Dec. 22, 2015

(87) PCT Pub. No.: WO2015/000625

PCT Pub. Date: Jan. 8, 2015

(65) Prior Publication Data

US 2016/0144375 A1 May 26, 2016

(30) Foreign Application Priority Data

Jul. 2, 2013 (EP) ..... 13174721

(51) Int. Cl.
*B02C 23/02* (2006.01)
*B02C 13/286* (2006.01)
*B02C 13/18* (2006.01)

(52) U.S. Cl.
CPC ..... *B02C 23/02* (2013.01); *B02C 13/1807* (2013.01); *B02C 13/286* (2013.01); *B02C 2013/28672* (2013.01)

(58) Field of Classification Search
CPC ..... B02C 13/286; B02C 13/1807; B02C 13/28672; B02C 23/02; B02C 18/067
(Continued)

(56) References Cited

U.S. PATENT DOCUMENTS 1,390,839 A * 9/1921 Sturtevant ..... B02C 15/02 241/109
1,724,403 A * 8/1929 Hutchinson ..... B28C 7/0007 222/77

(Continued)

FOREIGN PATENT DOCUMENTS

CN 87101899 A 9/1987
CN 102844118 A 12/2012

(Continued)

OTHER PUBLICATIONS

English translate KR200382010Y1, retrieved date Oct. 21, 2018.*

*Primary Examiner* — Faye Francis
*Assistant Examiner* — Mohammed S. Alawadi
(74) *Attorney, Agent, or Firm* — Corinne R. Gorski

(57) ABSTRACT

A vertical shaft impact crusher feed hopper distribution device arranged for feeding material to be crushed to a rotor of a vertical shaft impact crusher. The feed hopper distribution device is arranged to be mounted in a feed hopper that feeds material to the rotor and includes a supply channel that forwards material from an inlet opening arranged adjacent to an upper end of the supply channel to a hopper bottom opening arranged in a bottom of the feed hopper and communicating with the rotor. The supply channel has a cross-section that widens along at least a portion of the distance from the upper end to a lower end of the supply channel.

12 Claims, 4 Drawing Sheets

(58) Field of Classification Search
USPC ..... 241/275, 224, 5
See application file for complete search history.

(56) References Cited

U.S. PATENT DOCUMENTS 2,306,665 A * 12/1942 Schwarzkopf ..... C22C 33/02 75/356
2,440,171 A * 4/1948 Eldridge ..... B02C 7/06 241/32
2,737,289 A * 3/1956 Peters ..... B02C 2/007 198/570
3,140,056 A * 7/1964 Motosi ..... B02C 13/00 241/38
4,106,707 A 8/1978 Kemnitz
4,179,075 A * 12/1979 Rachais ..... B02C 13/1807 241/275
4,580,698 A * 4/1986 Ladt ..... B65G 47/19 177/122
4,662,571 A * 5/1987 MacDonald ..... B02C 13/1835 241/81
4,738,403 A * 4/1988 Sevelinge ..... B02C 13/1842 241/275
5,074,435 A * 12/1991 Suverkrop ..... B02C 23/02 222/55
5,257,743 A * 11/1993 Brown, Jr. ..... B02C 19/0031 241/248
5,366,170 A * 11/1994 Jones, Jr. ..... F27B 1/10 241/275
10,094,700 B2 * 10/2018 Ikeda ..... B65G 27/08
2005/0263636 A1 * 12/2005 Hur ..... B02C 13/286 241/275
2006/0011761 A1 * 1/2006 Dallimore ..... B02C 13/286 241/275
2010/0108790 A1 5/2010 Dallimore et al.

FOREIGN PATENT DOCUMENTS

DE 9308860 U1 10/1994
EP 2666543 A1 11/2013
GB 898976 A * 6/1962 ..... A47J 43/046
KR 200382010 Y1 * 4/2005
WO WO1996032197 A1 * 4/1996 ..... B02C 13/1814
WO 96/32197 A1 10/1996
WO WO2004020103 A1 * 8/2003 ..... B02C 13/1842

* cited by examiner

VSI-CRUSHER FEED HOPPER DISTRIBUTION DEVICE

RELATED APPLICATION DATA

This application is a § 371 National Stage Application of PCT International Application No. PCT/EP2014/060229 filed May 19, 2014 claiming priority of EP Application No. 13174721.4, filed Jul. 2, 2013.

TECHNICAL FIELD OF THE INVENTION

The present invention relates to a vertical shaft impact crusher feed hopper distribution device for feeding material to be crushed to a rotor of a vertical shaft impact crusher.

The present invention further relates to a method of crushing material in a vertical shaft impact crusher comprising a rotor arranged in a housing and a feed hopper means arranged for feeding material to the rotor.

BACKGROUND ART

Vertical shaft impact crushers (VSI-crushers) are used in many applications for crushing hard material like rocks, ore etc. A VSI-crusher comprising a housing and a horizontal rotor located inside the housing is described in WO 2004/020103 A1. A first flow of material to be crushed is fed to the rotor via an opening in the top thereof, is accelerated by the rotor, and is ejected towards the wall of the housing. An optional second flow of material may be fed outside of the rotor, i.e., between the rotor and the housing. This second flow of material is impacted by the first flow of material ejected by the rotor. Thereby, also the second flow of material is subjected to crushing action.

It would be beneficial to the efficiency of the crushing process to be able to increase the amount of material that can be crushed in a VSI-crusher of the type described in WO 2004/020103 A1.

SUMMARY OF THE INVENTION

It is an object of the present invention to provide a device which increases the amount of material that can be crushed in a VSI-crusher.

This object is achieved by a vertical shaft impact crusher feed hopper distribution device for feeding material to be crushed to a rotor of a vertical shaft impact crusher, wherein the feed hopper distribution device is adapted to be mounted in a feed hopper means feeding material to the rotor and comprises a supply channel which is adapted for forwarding material from an inlet opening arranged adjacent to an upper end of the supply channel to a hopper bottom opening arranged in a bottom of the feed hopper means and communicating with the rotor, the supply channel having a cross-section that widens along at least a portion of the distance from the upper end to a lower end of the supply channel.

An advantage of this feed hopper distribution device is that it is adapted to receive material falling from, for example, a conveyor and to forward that material, with minimum hindrance and at maintained high speed, vertically downwards to the rotor. The high speed of the material falling through the feed hopper distribution device means that more material can be charged into the rotor. This increases the amount of material that can be crushed in a vertical shaft impact (VSI) crusher. In particular in situations of crushing high amounts of material and/or materials that include large pieces of material this feed hopper distribution device results in increased crushing capacity compared to what was possible in the prior art.

The present vertical shaft impact crusher feed hopper distribution device may be mounted in the feed hopper means of new VSI-crushers. The present feed hopper distribution device may also be retrofitted as an upgrade of the feed hopper means of existing VSI-crushers.

The feed hopper means is that part of the VSI-crusher that first receives material to be crushed as supplied from, for example, a conveyor, such as a belt conveyor, or other type of material feeder.

According to one embodiment the feed hopper distribution device comprises an upper hopper portion located on top of the supply channel. An advantage of this embodiment is that the control of feeding material to the supply channel is improved. Furthermore, the upper end of the supply channel may be protected from wear, for example by a rock bed built up in the upper hopper portion.

According to one embodiment an upper throttle plate in which the inlet opening is arranged is located above the supply channel. An advantage of this embodiment is that the flow of material through the supply channel can be controlled to a suitable amount, such that the amount of material supplied to the supply channel flows through the supply channel unimpeded and at a high velocity, to obtain efficient charging of material into the rotor.

Preferably, the upper throttle plate is supported by the upper hopper portion. Thereby, wear protection and good control of the feeding of material to the supply channel is obtained.

According to one embodiment the upper hopper portion has the shape of an upwardly open cylinder to which material may be supplied and further forwarded to the supply channel. An advantage of this embodiment is that a rock bed may be efficiently built up inside the upper hopper portion along a side wall portion thereof to protect the inlet opening and/or any throttle plate from wear.

According to one embodiment the supply channel has, at least along a portion thereof, a shape selected among truncated cones, truncated pyramids, and bell-shapes. An advantage of this embodiment is that a supply channel having at least partly the form of, for example, a truncated cone or truncated pyramid, having its widest part at a lower end thereof, provides very little hindrance to the material flowing therethrough. Thereby, the material may pass at a high speed through the supply channel to be charged to the rotor. Furthermore, in particular the truncated cone and the truncated pyramid are mechanically stable shapes. According to a preferred embodiment the supply channel has, at least along a portion thereof, a shape selected among truncated cones and truncated pyramids.

According to one embodiment, the supply channel has the form of a truncated cone, truncated pyramid or is bell-shaped along at least 80% of its total vertical height. An advantage of this embodiment is the material may flow with very little hindrance and at a high speed through the supply channel, since the side wall of the supply channel turns aside from the material flow along most of the height of the supply channel.

According to one embodiment, the total vertical height of the supply channel is in the range of 0.2 to 2.0 meters, more preferably 0.5 to 1.5 meters. This height has been found suitable for most VSI-crushers, to achieve an efficient flow of material at high speed through the supply channel.

According to one embodiment the feed hopper distribution device is arranged to form part of a feed hopper means comprising an inner hopper and an outer hopper and to be mounted inside of the inner hopper, the feed hopper distribution device being arranged to forward a first flow of material to the rotor via the supply channel and to forward a second flow of material via at least one outlet formed in the inner hopper to a space formed between the inner and outer hoppers, and further to a position at the outside of the rotor. An advantage of this embodiment is that the feed hopper distribution device makes more efficient the supply of material to vertical shaft impact crushers of the type having a first flow of material flowing through the rotor and being accelerated thereby, and a second flow of material flowing outside of the rotor and being impacted by the first flow of material accelerated by the rotor. The present feed hopper distribution device increases the amount of the first flow of material that can be supplied to the rotor and increases the amount of the second flow of material that can be supplied at the outside of the rotor.

According to one embodiment the feed hopper distribution device has an upper inlet end dividing material to flow as a first flow of material to the rotor or to flow as a second flow of material to a position outside of the rotor. An advantage of this embodiment is that material distribution becomes efficient, and the flow of material, i.e. the second flow of material, flowing at the outside of the rotor does not impede the flow of material, i.e., the first flow of material, flowing to the rotor. Hence, the first flow of material may flow at high velocity to the rotor to achieve efficient charging of the rotor.

According to one embodiment an upper inlet end of the feed hopper distribution device is arranged to be located vertically above a lower end of at least one outlet formed in an inner hopper. An advantage of this embodiment is that the second flow of material may be forwarded efficiently, by sliding downwards from the feed hopper distribution device towards the outlets, to the position outside of the rotor. Thereby, also the second flow of material may be increased, as the second flow of material also flows at a high speed.

According to one embodiment a vertical distance HU between the upper inlet end of the feed hopper distribution device and the lower end of the at least one outlet formed in the inner hopper is in the range of 0.05 to 0.5 meters. Such a vertical distance HU has been found to result in an efficient slope for the material to slide on.

According to one embodiment the supply channel is adapted to form a material space together with the inner hopper and an inner hopper bottom of the inner hopper for housing an inner hopper wall of material in the feed hopper means. An advantage of this embodiment is that the material wall protects interior parts of the feed hopper means, including the feed hopper distribution device, from wear. Furthermore, the inner hopper wall of material assists in holding the feed hopper distribution device firmly in its correct position. Optionally, the upper hopper portion may, if present, also assist in forming the material space.

According to one embodiment a side wall of the supply channel forms an angle $\alpha$ of at least 5°, more preferably at least 10°, to the vertical plane. An advantage of this embodiment is that the flow of material through the supply channel is unimpeded, since the side wall widens, by at least 5°, and more preferably by at least 10°, in the downward direction. Furthermore, any inner hopper wall of material formed outside of the supply channel may also efficiently retain the supply channel in its desired position.

According to one embodiment a side wall of the supply channel forms an angle $\alpha$ of not more than 30°, more preferably not more than 25°, to the vertical plane. An advantage of this embodiment is that when the widening of the supply channel is not more than 30°, more preferably not more than 25°, this means that the side wall will still provide guidance to any objects of the material to be crushed occasionally diverting from the main vertical downward path of such material.

According to one embodiment an inner width of the inlet opening, optionally arranged at the upper throttle plate, is smaller than the width of the upper end of the supply channel. An advantage of this embodiment is that the restriction for material flow through the supply channel is more narrow than the supply channel itself. Thereby, the risk of material getting stuck in the supply channel is reduced. Furthermore, the risk that the supply channel hinders the flow of material therethrough is further reduced.

According to one aspect of the present invention there is provided a vertical shaft impact crusher comprising a rotor arranged in a housing and feed hopper means arranged for feeding raw material to be crushed to the rotor, wherein the feed hopper means comprises a feed hopper distribution device as described hereinabove. An advantage of this vertical shaft impact crusher is that the material flows vertically downwards at high speed, unimpeded by the hopper, which means that more material can be charged into the rotor.

A further object of the present invention is to provide an efficient method of crushing material in a vertical shaft impact crusher.

This object is achieved by means of method of crushing material in a vertical shaft impact crusher comprising a rotor arranged in a housing and a feed hopper means arranged for feeding material to the rotor, the method comprising:

feeding material to be crushed to a feed hopper distribution device of the feed hopper means, forwarding the material to be crushed via a supply channel of the feed hopper distribution device, the supply channel having a cross-section that widens along at least a portion of the distance from an upper end to a lower end of the supply channel, to a hopper bottom opening arranged in a bottom of the feed hopper means, and feeding the material further to the rotor for being crushed.

An advantage of this method is that the rotor is charged with more material, since the material flows into the rotor unimpeded by the supply channel and thereby at a high speed. Thereby, an increased amount of material can be crushed.

According to one embodiment the method further comprises utilizing the feed hopper distribution device for dividing the material to be crushed into a first flow of material and supplying that flow via the supply channel to the rotor, and a second flow of material and supplying that flow outside of the supply channel to a position outside of the rotor for being impacted by the first flow of material accelerated by the rotor. An advantage of this embodiment is that an increased flow of material is forwarded to the rotor as the first flow of material, due to the high speed of the material forwarded through the supply channel, and this increased first flow of material is subsequently accelerated by the rotor and causes an increased crushing of the second flow of material which flows outside of the rotor.

According to one embodiment the method further comprises forming a wall of material in a material space formed between the supply channel, an inner hopper of the feed hopper means and an inner hopper bottom of the inner hopper, and allowing the second flow of material to slide along a slope formed on the wall of material and extending from an upper inlet end of the feed hopper distribution device to at least one outlet formed in the inner hopper and further to the position outside of the rotor. An advantage of this embodiment is that the second flow of material will flow quicker, since it may slide on the slope, thereby increasing the amount of the second flow of material that can be charged to the crusher. Furthermore, the wall of material may support the feed hopper distribution device and keep it in a correct position within the feed hopper means.

According to one embodiment the method further comprises arranging an upper throttle plate at the top of the supply channel and selecting that width of an inlet opening of the upper throttle plate that provides the largest amount of material flowing vertically down through the supply channel to the rotor. An advantage of this embodiment is that the upper throttle plate and the method of selecting a suitable width of the inlet opening thereof provides an efficient method of optimizing the amount of material that may be charged to the rotor via the feed hopper distribution device.

Further objects and features of the present invention will be apparent from the description and the claims.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
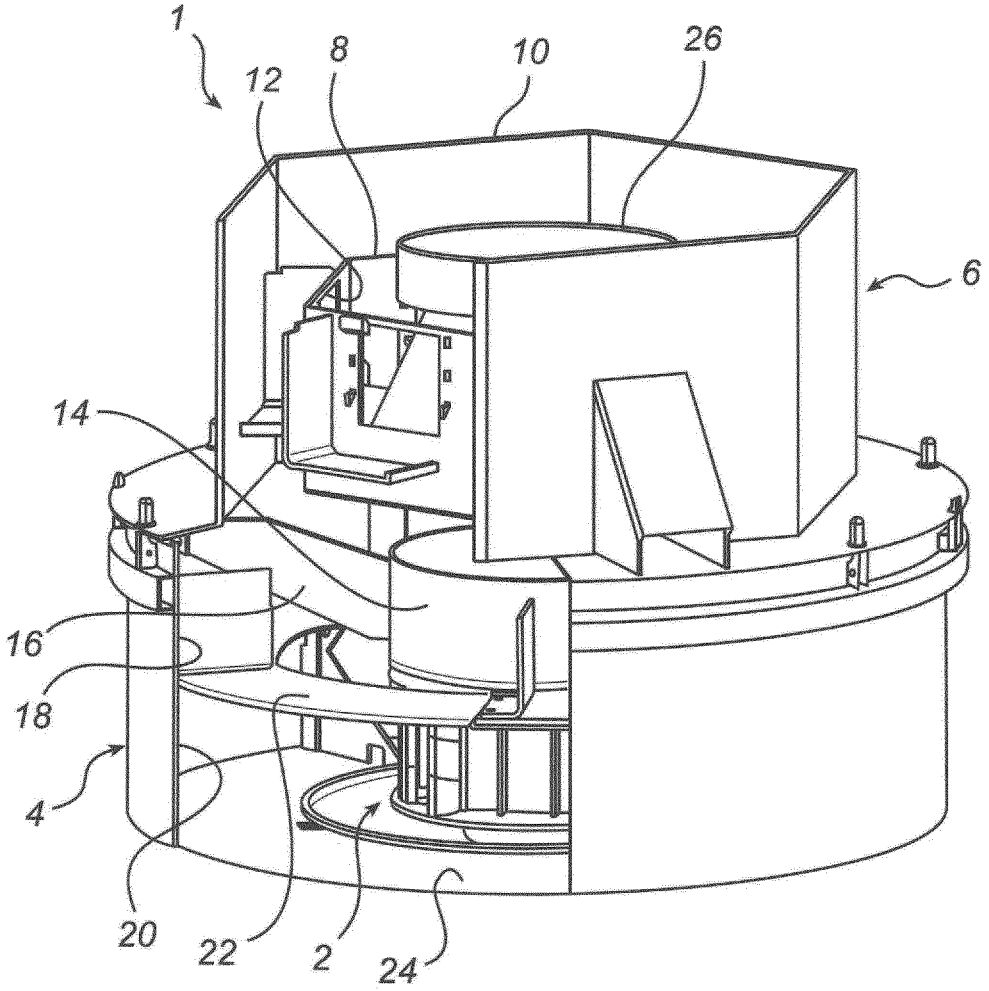
FIG. 1 is a three-dimensional view, partly in section, and illustrates a vertical shaft impact crusher.

FIG. 1 illustrates, partly in cross-section, a vertical shaft impact (VSI) crusher 1. A rotor 2 is located inside a housing 4 of the crusher 1. The rotor 2 may, for example, be of a per se known type, for example of the type disclosed in WO 2004/020103 A1. At the top of the crusher 1 a feed hopper means 6 is located. The feed hopper means 6 comprises an inner hopper 8, and an outer hopper 10 surrounding the inner hopper 8. The feed hopper means 6 is that part of the VSI-crusher 1 that first receives material to be crushed as supplied from, for example, a conveyor, such as a belt conveyor, or another type of material feeder.

Outlets 12 are arranged in the inner hopper 8. A central feeding funnel 14 is placed inside the housing 4, below the feed hopper means 6. The central feeding funnel, which in this embodiment has the shape of a central feeding cylinder 14, is fixed to the inside of the housing 4 with the aid of three beams, of which only the beam 16 is shown in FIG. 1.

A circumferential distributing wall section 18 is located at the same level as the feeding cylinder 14. Below the distributing wall section 18 and on the same level as the rotor 2 a circumferential impact wall section 20 is located. A cavity ring 22 separates the distributing wall section 18 from the impact wall section 20. A bed retention ring 24 is located at the bottom of the crusher 1.

The feed hopper means 6 is provided with a feed hopper distribution device 26 for efficient feeding of material to the rotor 2. The feed hopper distribution device 26 will be described in more detail hereinafter with reference to FIGS. 3 and 4.

Figure 2:
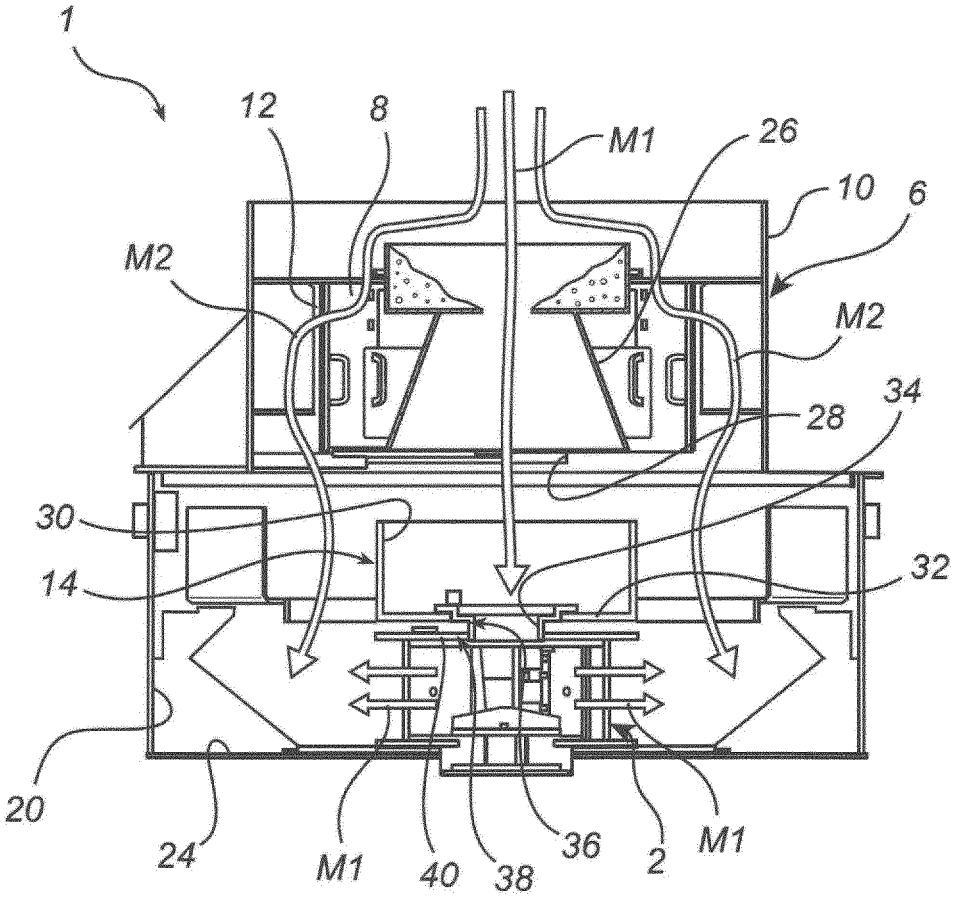
FIG. 2 is a cross-section, and illustrates internal parts of the vertical shaft impact crusher.

FIG. 2 is a cross-section of the VSI-crusher 1 and illustrates the operating principle. During operation of the VSI-crusher 1 material to be crushed is fed to the feed hopper means 6. A first flow of material M1 will reach the rotor 2 by flowing vertically downwards through the feed hopper distribution device 26 of the feed hopper means 6, an inner hopper bottom opening 28, which is located at the bottom of the inner hopper 8 of the feed hopper means 6, and the feeding cylinder 14 arranged below the feed hopper means 6. The rotor 2 rotates at high speed and ejects the first flow of material M1 supplied thereto horizontally towards the impact wall section 20. A second flow of material M2 will be forwarded, via the outlets 12 of the inner hopper 8, to a position outside of the rotor 2. The second flow of material M2 leaving the outlets 12 will pass, outside of the rotor 2, down into a position adjacent to the impact wall section 20. Adjacent to the impact wall section 20 the second flow of material M2 will be impacted by the first flow of material M1 ejected by the rotor 2, which will result in crushing of both flows of material M1 and M2. A bed of retained material (not shown), against which the two flows of material M1 and M2 may impact, is built up on the bed retention ring 24 during operation of the crusher 1, and protects the impact wall section 20 from wear.

The central feeding cylinder 14 comprises a side wall 30, which may, for example, be circular, and a bottom 32. The bottom 32 of the feeding cylinder 14 is provided with a centrally arranged rotor feeding opening 34 through which the first flow of material M1 may pass from the central feeding cylinder 14 and into the rotor 2.

To protect the internal edges of the rotor feeding opening 34 a vertical shaft impact crusher feed tube 36 is mounted to the bottom 32, extends through the rotor feeding opening 34, and opens into an opening 38 arranged in a roof 40 of the rotor 2.

Figure 3:
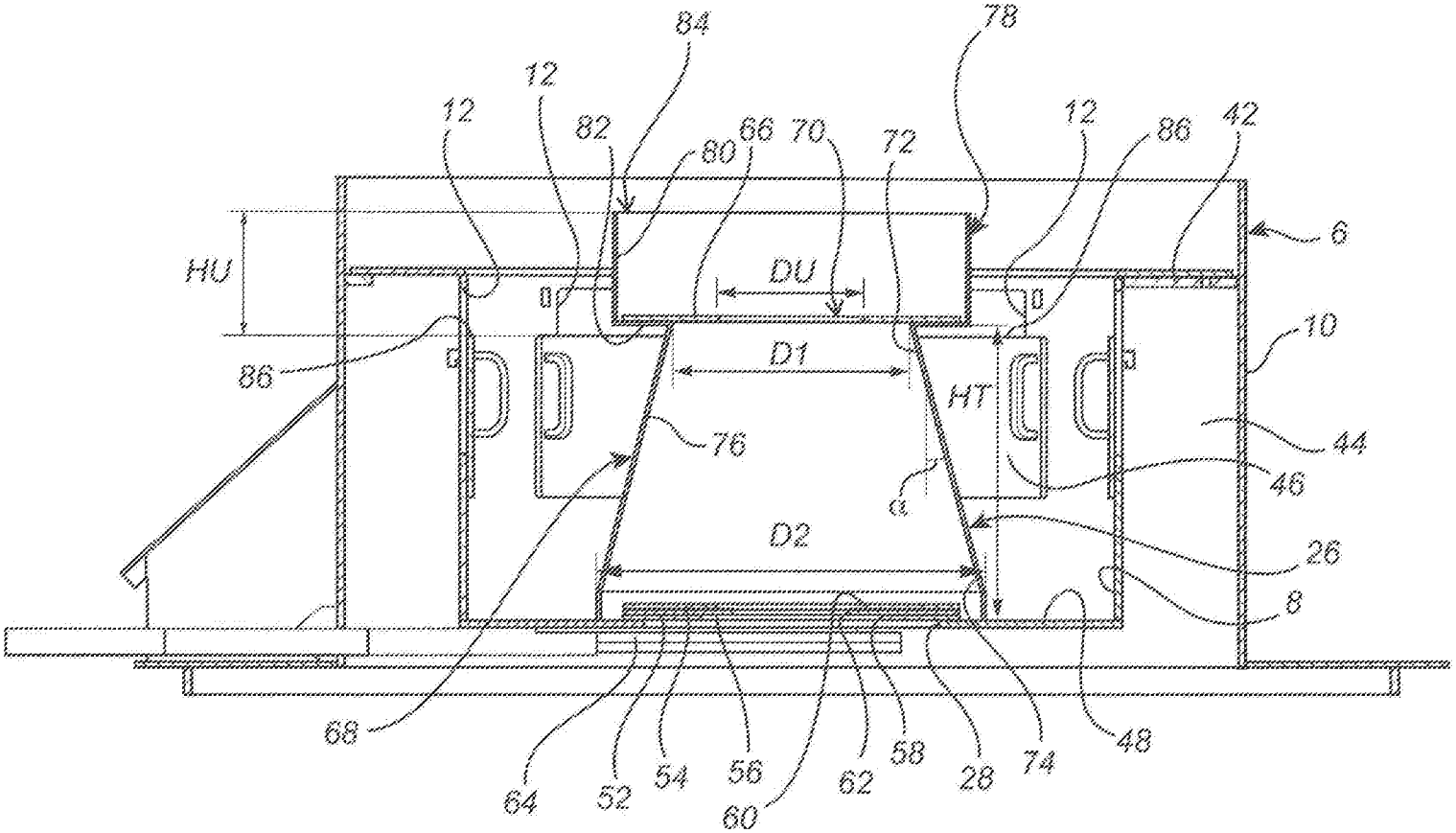
FIG. 3 is a cross-section, and illustrates internal parts of a feed hopper means of the vertical shaft impact crusher.

FIG. 3 illustrates the feed hopper means 6 in more detail. The feed hopper means 6 comprises the inner hopper 8 and the outer hopper 10. An outer hopper roof 42 covers a second material flow space 44 that is formed between the inner hopper 8 and the outer hopper 10. The second flow of material M2 illustrated in FIG. 2 may reach the second material flow space 44 via the outlets 12 arranged in the inner hopper 8 and may be further forwarded down to the position adjacent to the impact wall section 20 as described hereinbefore with reference to FIG. 2.

Each outlet 12 may be provided with a control hatch 46. Each control hatch 46 can be located in various vertical positions to adjust the height of the respective outlet 12. Thereby the amount of the second flow of material M2 passing through each outlet 12 can be adjusted.

The inner hopper 8 has an inner hopper bottom 48. The inner hopper bottom 48 is provided with the inner hopper bottom opening 28 through which the first flow of material M1 may pass on its way towards the rotor 2 illustrated in FIG. 2. To control the flow of material through the bottom opening 28 one or more bottom throttle plates 52, 54, 56 may be arranged on the inner hopper bottom 48. Each bottom throttle plate 52, 54, 56 has a central opening 58, 60, 62, respectively, which is more narrow than the inner hopper bottom opening 28. Thereby, the flow of material through the bottom opening 28 can be restricted to a suitable degree.

Optionally, a sliding throttle 64 may be arranged below the bottom opening 28 for the purpose of further throttling the flow of material through the bottom opening 28 in low load situations.

The feed hopper distribution device 26 comprises an upper throttle plate 66 and a supply channel 68 extending from the upper throttle plate 66 to the inner hopper bottom 48. The upper throttle plate 66 is provided with an inlet opening 70 which is aligned with the bottom opening 28. In FIG. 3 only one upper throttle plate 66 is shown, but the feed hopper distribution device 26 typically comprises a set of 2-5 separate upper throttle plates 66 having various widths of their respective openings 70. Normally, only one upper throttle plate 66 is mounted at a time.

The supply channel 68 has a cross-section that widens in the downward direction, i.e., the cross-section of the supply channel 68 widens from its upper end 72 to its lower end 74. In the embodiment shown in FIG. 3 the supply channel 68 has the form of a truncated cone and the width D1 at its upper end 72 is smaller than the width D2 at its lower end 74. A side wall 76 of the supply channel 68 typically forms an angle $\alpha$ of 5-30° to the vertical plane. Preferably, the supply channel 68 has the form of a truncated cone along at least 80% of its total vertical height HT. Typically, the total vertical height HT of the supply channel 68 is in the range of 0.2 to 2.0 meters, more preferably 0.5 to 1.5 meters, depending on the size of the crusher. In the embodiment of FIG. 3 the supply channel 68 has the form of a truncated cone along about 95% of its total vertical height HT, with only a short cylindrical portion at its lower end 74 to facilitate mounting the supply channel 68 to the inner hopper bottom 48. According to one embodiment the inner width DU of the opening 70 of the upper throttle plate 66 is smaller than the width D1 of the upper end 72 of the supply channel 68. Thereby, the restriction to flow of material through the supply channel 68 is set upstream of the supply channel 68, and the risk that material flow is obstructed by the supply channel 68 itself is further reduced.

According to one embodiment the feed hopper distribution device 26 comprises an optional upper hopper portion 78. The upper hopper portion 78 is located on top of the supply channel 68. The upper hopper portion 78 comprises a vertical cylindrical side wall portion 80, and a bottom portion 82 resting on the supply channel 68. The upper throttle plate 66 rests on the bottom portion 82.

The cylindrical side wall portion 80 has an upper inlet end 84 that functions as a divider controlling if the material supplied to the VSI-crusher is to flow, as the first flow of material M1, to the supply channel 68, or flow, as the second flow of material M2, to the outlets 12 and further. The upper inlet end 84 is located vertically above the respective lower ends 86 of the outlets 12. Typically, a vertical distance HU between the upper inlet end 84 and the respective lower ends 86 of the outlets 12 is in the range of 0.05 to 0.5 meters depending on the actual setting of the respective hatches 46.

In an alternative embodiment in which there is no optional upper hopper portion 78 the upper throttle plate 66 may rest directly on top of the supply channel 68, and the upper throttle plate 66 would, in such embodiment, be that upper inlet end which is located above the respective lower ends 86 of the outlets 12.

Figure 4:
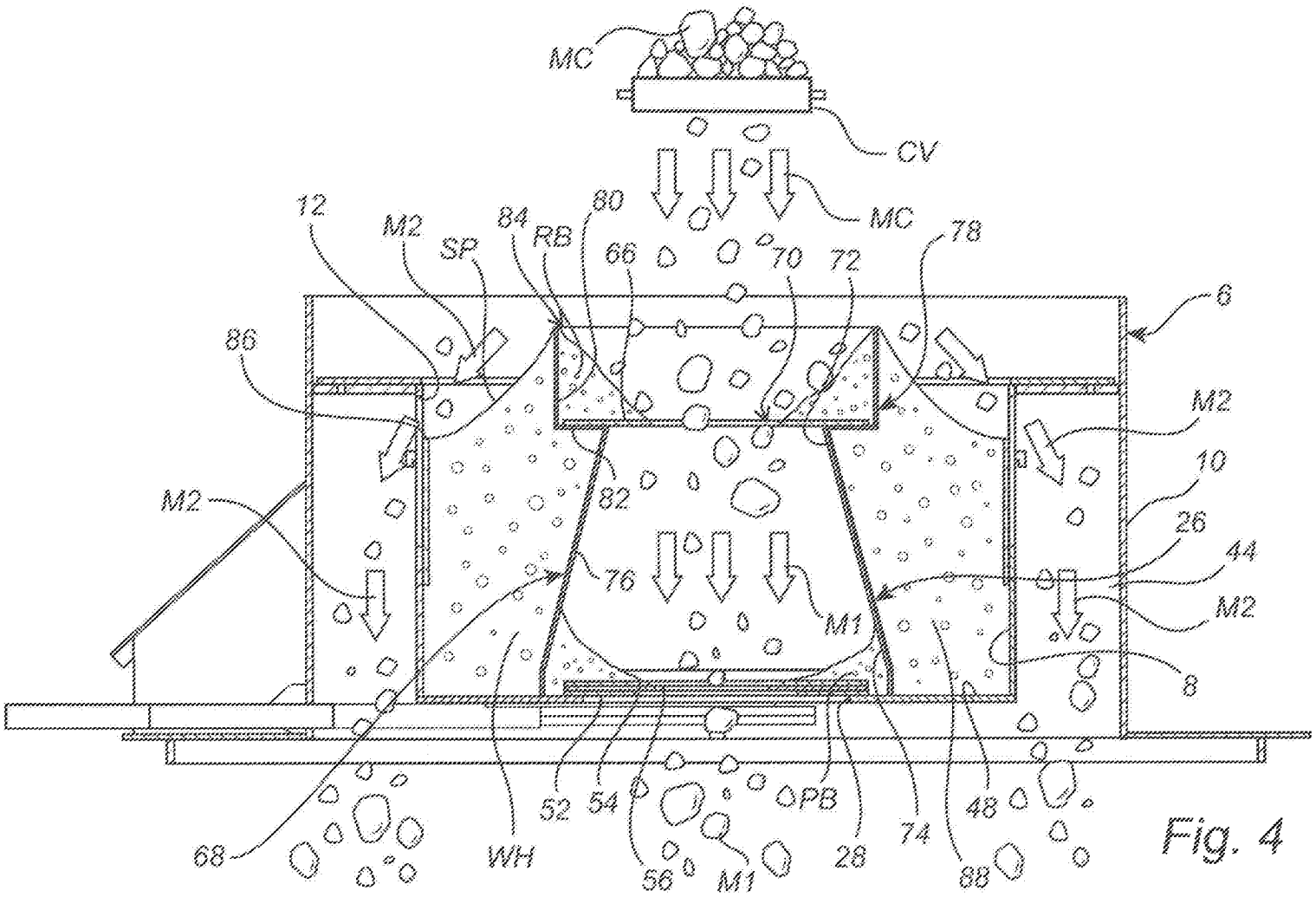
FIG. 4 is a cross-section, and illustrates internal parts of a feed hopper means during operation of the crusher.

FIG. 4 illustrates the feed hopper means 6 during operation of the VSI-crusher. Raw material MC to be crushed is fed to the feed hopper means 6 from a conveyor CV. The feed hopper distribution device 26 of the feed hopper means 6 serves to divide the raw material MC into the first flow of material M1 and the second flow of material M2. The raw material MC enters the upper hopper portion 78 of the feed hopper distribution device 26. Due to the vertical cylindrical side wall portion 80 and the bottom portion 82 a rock bed RB is built up inside the upper hopper portion 78 along the side wall portion 80. This rock bed RB protects the upper throttle plate 66 from wear, and serves to direct some material, as part of the first flow of material M1, towards the opening 70 of the upper throttle plate 66. A large portion of the first flow of material M1 will, however, fall directly vertically down through the opening 70 of the upper throttle plate 66, without any contact with the rock bed RB, and then fall further into the supply channel 68. Since the supply channel 68 widens from its upper end 72 to its lower end 74 the first flow of material M1 will fall at high speed through the supply channel 68 with no or almost no obstruction from the side wall 76. The first flow of material M1 will, hence, quickly pass through the supply channel 68 and leave the feed hopper means 6 via the inner hopper bottom opening 28 and fall further to the rotor 2 illustrated in FIG. 2. This high speed of the first flow of material M1 falling unobstructed into the rotor 2 will increase the amount of material charged into the rotor 2 and increase the amount of material that can be crushed.

A small protecting bed of material PB may form inside the supply channel 68, at the lower end 74 thereof, as illustrated in FIG. 4. This protecting bed PB comprises small pieces of rock that more or less randomly leave the main stream of the first flow of material M1. The protecting bed PB will not be a compacted bed like the rock bed RB that is formed in the upper hopper portion 78, since the protecting bed PB is not exposed to any significant impact by material falling thereon. On the contrary, the protecting bed PB will merely be a loose heap of material having a rather low density and a quite low height corresponding to the angle of repose of the material in question. Furthermore, the building of any significant height of the protecting bed PB is also hindered by the fact that the side wall 76 forms the angle $\alpha$ to the vertical plane, and "leans" over the protecting bed PB. Still, the protecting bed PB will serve to protect the bottom throttle plates 52, 54, 56 and parts of the inner hopper bottom 48 from wear. Hence, the protecting bed PB will have a protecting function without substantially interfering with the first flow of material M1 flowing at high speed past the protecting bed PB.

The second flow of material M2 that is directed by the feed hopper distribution device 26 towards the outlets 12 of the inner hopper 8 will initially build an inner hopper wall WH of material in a material space 88 formed between the outer side of the supply channel 68 and the upper hopper portion 78 on the one hand and the inner hopper bottom 48 and the inner side of the inner hopper 8 on the other hand. Once the inner hopper wall WH of material has been formed a slope SP will form and extend from the upper inlet end 84 of the cylindrical side wall portion 80 and downwards towards the respective lower ends 86 of the outlets 12. The second flow of material M2 will slide along this slope SP from the upper hopper portion 78 towards the outlets 12 and will pass through the outlets 12 and further, via the material flow space 44 formed between the inner hopper 8 and the outer hopper 10, down to the position outside of the rotor 2, as illustrated in FIG. 2. Furthermore, the inner hopper wall WH of material will support the feed hopper distribution device 26 and will assist in holding the feed hopper distribution device 26 firmly in its correct position.

In FIGS. 3 and 4 it is illustrated that all three bottom throttle plates 52, 54, 56 are mounted in the crusher. It will be appreciated that normally only one throttle plate at a time would be mounted, since the throttling effect will be determined by that throttle plate which has the narrowest opening.

When adjusting the crusher for operation at maximum capacity that upper throttle plate 66 that has the narrowest width of its opening 70 is first selected, and the conveyor CV is operated at that speed at which almost all of the raw material MC falls directly through the supply channel 68 of the feed hopper distribution device 26 as the first flow of material M1. The width of the upper throttle plate 66 is gradually widened, by selecting a throttle plate 66 with a wider opening 70 or by mechanically widening the opening 70, and the flow of raw material MC supplied via the conveyor CV is increased until the motor (not shown) driving the rotor 2 reaches its maximum capacity.

Typically, the width of the bottom throttle plate 52, 54, 56 is also gradually widened together with widening the width of the opening 70 of the upper throttle plate 66. The width of the central opening 58, 60, 62 of the currently selected bottom throttle plate 52, 54, 56 is typically selected to be in the same range as, or slightly larger than, the width of the opening 70 of the upper throttle plate 66. Thereby, the main restriction to the first flow of material M1 will be the upper throttle plate 66. If material would inadvertently build up inside of the supply channel 68, a bottom plate, e.g., bottom plate 52, having an opening 58 that is wider than the opening 70 of the upper throttle plate 66 could be selected.

When the maximum amount of the first flow of material M1 in view of the capacity of the motor has thus been reached the flow of raw material MC supplied by the conveyor CV is further increased to make the upper hopper portion 78 overflow. Such overflow of the upper hopper portion 78 generates the second flow of material M2 flowing from the upper hopper portion 78, over the upper inlet end 84, sliding over the slope SP of the inner hopper wall WH of material and being further forwarded via the outlets 12 and the space 44 to the position outside of the rotor 2 where the second flow of material M2 is impacted by the first flow of material M1, as indicated in FIG. 2. Hence, by means of the feed hopper distribution device 26 having the supply channel 68 with its cross-section that widens from its upper end 72 to its lower end 74 it becomes possible to feed more material to the rotor 2, because the first flow of material M1 flows directly at high speed through the supply channel 68 and into the rotor 2. Furthermore, also the second flow of material M2 may be increased, since the second flow of material M2 flows quickly along the slope SP to the space 44 and further into the first flow of material M1 ejected by the rotor 2. Still further, since the first flow of material M1 is increased that flow of material M1 also has, after being ejected from the rotor 2, increased capacity to crush the second flow of material M2, thereby even further increasing the capacity for crushing material in the crusher 1.

It will be appreciated that numerous modifications of the embodiments described above are possible within the scope of the appended claims.

Hereinbefore it has been described that the supply channel 68 has the shape of a truncated cone. It will be appreciated that the supply channel 68 may also have other shapes. For example, the supply channel may have the form of a truncated pyramid with, for example, four, five or six sides. In the embodiment shown in FIGS. 1-4 with inner and outer hoppers 8, 10 having six faces, the supply channel could suitably be a truncated pyramid with six sides to fit with the inner and outer hoppers 8, 10. Furthermore, the supply channel may also be bell shaped, having a side wall which is not straight but follows a curve.

Hereinbefore it has been shown that the feed hopper distribution device 26 is provided with a supply channel 68 and an upper hopper portion 78 mounted on the supply channel 68. According to an alternative embodiment the feed hopper distribution device 26 comprises a supply channel 68 but no upper hopper portion 78. In such an embodiment the inlet opening 70 is arranged adjacent to the upper end 72 of the supply channel 68.

Hereinbefore it has been shown how the upper inlet end 84 is arranged at the very top of the upper hopper portion 78. In the optional embodiment where there is no upper hopper portion present in the feed hopper distribution device, the upper inlet end may be arranged adjacent to the upper end 72 of the supply channel 68. Furthermore, in such an embodiment the upper inlet end of the feed hopper distribution device 26 could actually coincide with the upper end 72 of the supply channel 68.

To summarize, a vertical shaft impact crusher feed hopper distribution device (26) is adapted for feeding material to be crushed to a rotor (2) of a vertical shaft impact crusher (1). The feed hopper distribution device (26) is adapted to be mounted in a feed hopper means (6) feeding material to the rotor (2) and comprises a supply channel (68) which is adapted for forwarding material from an inlet opening (70) arranged adjacent to an upper end (72) of the supply channel (68) to a hopper bottom opening (28) arranged in a bottom (48) of the feed hopper means (6) and communicating with the rotor (2). The supply channel (68) has a cross-section that widens along at least a portion of the distance from the upper end (72) to a lower end (74) of the supply channel (68).

The invention claimed is:

1. A feed hopper distribution device for feeding material to be crushed to a rotor of a vertical shaft impact crusher, the feed hopper distribution device being arranged to be mounted in and to form part of a feed hopper means feeding the material to be crushed to the rotor, the feed hopper means including an inner hopper and an outer hopper, the feed hopper distribution device comprising:

a supply channel arranged for forwarding the material to be crushed from an inlet opening arranged adjacent to an upper end of the supply channel to a hopper bottom opening arranged in a bottom of the inner hopper and communicating with the rotor, the material to be crushed being separable into a first flow and a second flow, the supply channel having a cross-section that widens along at least a portion of the distance from the upper end to a lower end of the supply channel, the feed hopper distribution device being arranged to be mounted inside of the inner hopper and to forward the first flow of the material to be crushed to the rotor via the supply channel and to forward the second flow of the material to be crushed via at least one outlet formed in the inner hopper to a space formed between the inner and outer hoppers, and further to a position at the outside of the rotor; and an upper hopper portion located on top of the supply channel, the upper hopper portion having a bottom portion and an upper inlet end, wherein the upper hopper portion supports at least one upper throttle plate at the bottom portion, the inlet opening being arranged in the at least one upper throttle plate and being aligned with the hopper bottom opening, the supply channel extending from the at least one upper throttle plate to the inner hopper bottom.

2. The feed hopper distribution device according to claim 1, wherein the upper hopper portion has a shape of an upwardly open cylinder to which the material to be crushed may be supplied and further forwarded to the supply channel.

3. The feed hopper distribution device according to claim 1, wherein the supply channel has, at least along a portion thereof, a shape selected from truncated cones, truncated pyramids, and bell-shapes.

4. The feed hopper distribution device according to claim 1, further comprising an upper inlet end dividing the material to be crushed to flow as the first flow of material to be crushed to the rotor or to flow as the second flow of material to be crushed to the position outside of the rotor.

5. The feed hopper distribution device according to claim 4, wherein the upper inlet end of the feed hopper distribution device is arranged to be located vertically above a lower end of the at least one outlet.

6. The feed hopper distribution device according to claim 1, wherein the supply channel is arranged to form a material space together with the inner hopper and an inner hopper bottom of the inner hopper for housing an inner hopper wall of material to be crushed in the feed hopper means.

7. The feed hopper distribution device according to claim 1, wherein a side wall of the supply channel forms an angle $\alpha$ of 5-30° to the vertical plane.

8. The feed hopper distribution device according to claim 1, wherein an inner width of the inlet opening, arranged at an upper throttle plate, is smaller than the width of the upper end of the supply channel.

9. A vertical shaft impact crusher comprising:

a rotor arranged in a housing;

a feed hopper means arranged for feeding raw material to be crushed to the rotor, the feed hopper means including an inner hopper and an outer hopper; and a feed hopper distribution device arranged as part of the feed hopper means, the feed hopper distribution device including a supply channel arranged for forwarding the material to be crushed from an inlet opening arranged adjacent to an upper end of the supply channel to a hopper bottom opening arranged in a bottom of the inner hopper and communicating with the rotor, the material to be crushed being separable into a first flow and a second flow, wherein an upper hopper portion is located on top of the supply channel, the upper hopper portion having a bottom portion and an upper inlet end, wherein the upper hopper portion supports at least one upper throttle plate at the bottom portion, the inlet opening being arranged in the at least one upper throttle plate and being aligned with the hopper bottom opening, the supply channel extending from the at least one upper throttle plate to the inner hopper bottom and having a cross-section that widens along at least a portion of the distance from the upper end to a lower end of the supply channel, the feed hopper distribution device being arranged to be mounted inside of the inner hopper and to forward the first flow of material to be crushed to the rotor via the supply channel and to forward the second flow of material to be crushed via at least one outlet formed in the inner hopper to a space formed between the inner and outer hoppers, and further to a position at the outside of the rotor.

10. A method of crushing material in a vertical shaft impact crusher having a rotor arranged in a housing and a feed hopper means arranged for feeding material to be crushed to the rotor, the method comprising:

providing a feed hopper distribution device including a supply channel disposed in an inner hopper and arranged for forwarding the material to be crushed from an inlet opening arranged adjacent to an upper end of the supply channel to a hopper bottom opening arranged in a bottom of the inner hopper and communicating with the rotor, and an upper hopper portion located on top of the supply channel, the upper hopper portion having a bottom portion and an upper inlet end, the upper hopper portion supporting at least one upper throttle plate, and the inlet opening being arranged in the at least one upper throttle plate at the bottom portion and being aligned with the hopper bottom opening, the supply channel extending from the at least one upper throttle plate to the inner hopper bottom;

feeding material to be crushed to the feed hopper distribution device of the feed hopper means;

forwarding the material to be crushed via the supply channel of the feed hopper distribution device, the supply channel having a cross-section that widens along at least a portion of the distance from an upper end to a lower end of the supply channel to the hopper bottom opening;

utilizing the feed hopper distribution device for dividing the material to be crushed into a first flow of material and supplying that first flow via the supply channel to the rotor, and a second flow of material and supplying that second flow outside of the supply channel to a position outside of the rotor for being hit by the first flow of material accelerated by the rotor; and feeding the material further to the rotor for being crushed.

11. The method according to claim 10, further comprising the steps of forming a wall of material in a material space formed between the supply channel, an inner hopper of the feed hopper means and an inner hopper bottom of the inner hopper, and allowing the second flow of material to slide along a slope formed on the wall of material and extending from an upper inlet end of the feed hopper distribution device to at least one outlet formed in the inner hopper and further to the position outside of the rotor.

12. The method according to claim 11, further comprising the step of arranging the upper throttle plate at the top of the supply channel and selecting a width of an inlet opening of the upper throttle plate that provides the largest amount of material to be crushed flowing vertically down through the supply channel to the rotor.

* * * * *